US006095880A

United States Patent [19]

Giunta

[11] Patent Number: 6,095,880

[45] Date of Patent: Aug. 1, 2000

[54] SKI ROPE ASSEMBLY

[76] Inventor: Giovanni Giunta, 58 Sophia Street, Roseville, Pretoria, Gauteng Province, South Africa

[21] Appl. No.: 09/273,503

[22] Filed: Mar. 22, 1999

[30] Foreign Application Priority Data

Mar. 23, 1998 [ZA] South Africa ..... 98/2440

[51] Int. Cl.[7] ..... B63B 35/85

[52] U.S. Cl. ..... 441/69; 114/253

[58] Field of Search ..... 114/221 R, 253; 441/69; 403/348, 349

[56] References Cited

U.S. PATENT DOCUMENTS

| | | | |
|---|---|---|---|
| 2,943,591 | 7/1960 | Schneider . | |
| 2,998,797 | 9/1961 | Risney | 441/69 |
| 3,109,075 | 10/1963 | Ratcliff | 114/253 |
| 3,148,655 | 9/1964 | Brant . | |
| 3,304,904 | 2/1967 | Spurlock | 441/69 |
| 3,650,237 | 3/1972 | Hartman | 114/253 |

FOREIGN PATENT DOCUMENTS

| | | | |
|---|---|---|---|
| 676374 | 2/1921 | France | 403/349 |
| 1511983 | 4/1968 | France . | |

*Primary Examiner*—S. Joseph Morano
*Assistant Examiner*—Ajay Vasudeva
*Attorney, Agent, or Firm*—Banner & Witcoff, Ltd.

[57] ABSTRACT

A ski rope assembly is provided in which two separate handles are attached one to each end of a rope forming a bridle and being attached to the ski rope by way of an attachment member movable along at least the central region of the bridle rope connecting the two handles. The two handles may be releasably attachable to each other in collinear relationship to provide the facility of switching between a one and a two handle configuration.

8 Claims, 3 Drawing Sheets

SKI ROPE ASSEMBLY

FIELD OF THE INVENTION

This invention relates to a ski rope assembly by which term is meant any rope assembly used to tow a person behind a vehicle such as, behind a boat when the person is water skiing or being towed behind a boat on a boogie board or any other device adapted to plane over the water. For the purposes of this specification the term "ski rope" means the rope that actually attaches to the towing vehicle, usually a boat; the term "bridle" means the rope arrangement attaching the handle or handles to the ski rope; and the term "rope" means any suitable flexible elongate member.

BACKGROUND TO THE INVENTION

As far as applicant is aware water skiing and analogous activities where a person is towed behind a boat, all employ a ski rope having a single handle at the free end thereof for a person to grip, the ends of the handle being attached to the ski rope itself by a bridle. The opposite end of the ski rope is simply attached to a tow facility on a boat.

The degree of control achievable using a ski rope with a single handle of this nature is limited and the arrangement may be restrictive on manoeuvres which a person can perform whilst skiing or otherwise being towed behind a boat or by means of any other device.

OBJECT OF THE INVENTION

It is the object of this invention to provide a ski rope assembly which results in more versatility, steering ability and control.

SUMMARY OF THE INVENTION

In accordance with this invention there is provided a ski rope assembly comprising a handle arrangement connected by means of a bridle to an attachment member adapted to be attached to either a ski rope or to a tow facility on a towing vehicle, the ski rope assembly being characterised in that the handle arrangement comprises a pair of handles interconnected by a bridle rope with one handle being attached to each end of the bridle rope and wherein the attachment member is movable along at least the central region of the length of the bridle rope.

Further features of the invention provide for the attachment member to have a pulley on which the bridle rope interconnecting the handles is adapted to run in use; and for the attachment member to have an eye through which the ski rope can be threaded and fastened, the eye preferably being attached to the attachment member by means of a swivel Still further features of the invention provide for the handles to each have a lateral handle extension extending generally at an obtuse angle to the handle itself and optionally being of arcuate shape; and for the two handles to be releasably attachable to each other in collinear relationship, such attachment preferably using a releasable coupling such as a bayonet type of coupling.

In order that the invention may be more fully understood one embodiment thereof will now be described with reference to the accompanying drawings.

DETAILED DESCRIPTION WITH REFERENCE TO THE DRAWINGS

Figure 1:
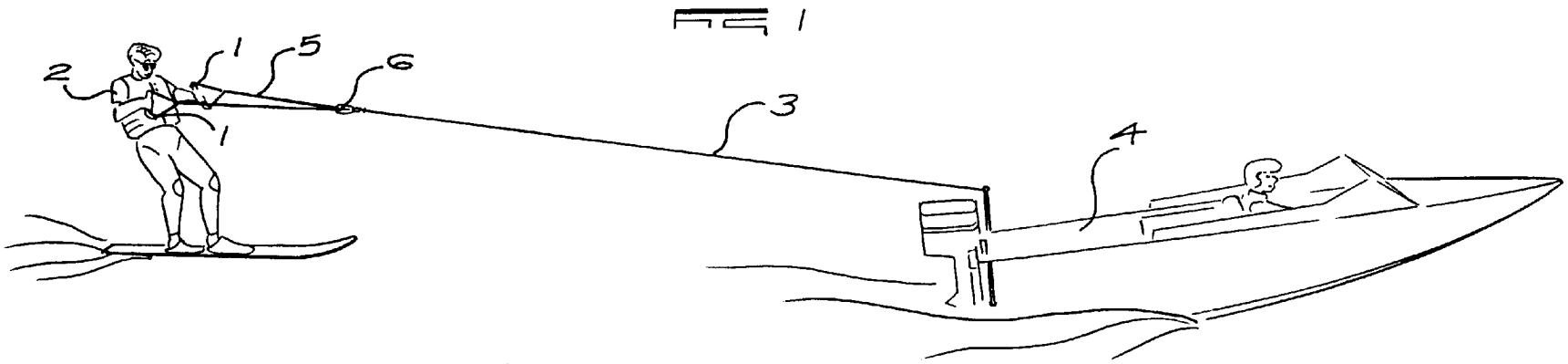
FIG. 1 illustrates a water skier being towed behind a boat.

As illustrated in the drawings, the ski rope assembly according to the invention comprises a pair of handles (1) adapted, in use, to be gripped one by each hand of a person (2) being towed by means of a ski rope (3) behind a boat (4). The handles are interconnected by a bridle rope (5) which passes through an attachment member (6) in the form of a small pulley block having an eye (8) to which the ski rope (3) itself is attached. The eye is, in this case, attached to the pulley block, by means of a swivel (9).

In the operative position of the various components the bridle rope (5) interconnecting the handles (1) runs on the pulley in the pulley block (6) which is towed along by virtue of the ski rope (3) being engaged with the eye (8) of the pulley block.

Thus, in use by a person who is being towed by means of the ski rope assembly described above, one side of the bridle rope (5) interconnecting the handles can be shortened with the other one being correspondingly lengthened and with such movements being made with dexterity and complimentary body movements it is envisaged that a large range of manoeuvres can be performed which were not heretofore possible. In any event the ski rope assembly of this invention improves the steering ability, control and accessibility available to a skier.

In order to facilitate holding onto the handles in certain circumstances the one end region of each handle has an extension (10) at an obtuse angle to the handle itself. The extension (10) can be somewhat arcuate in shape and is preferably shaped somewhat like a pistol grip for ease of holding in use.

Figure 2:
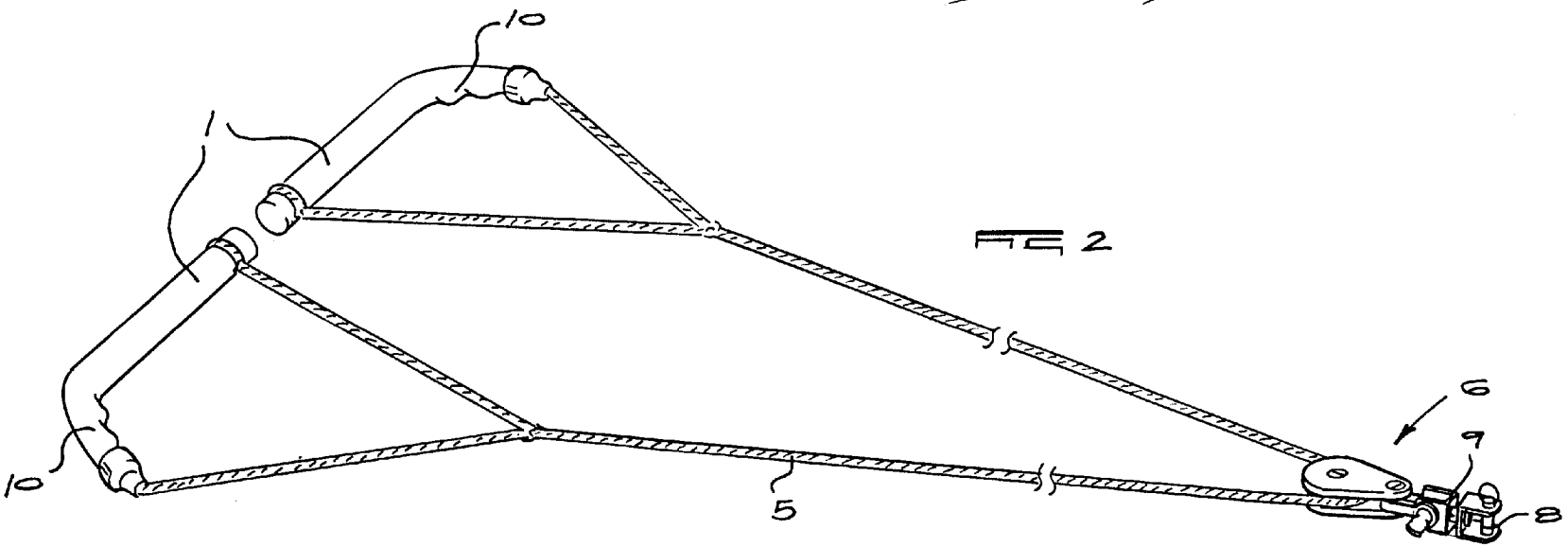
FIG. 2 is an enlarged isometric view of one embodiment of ski rope assembly provided by this invention.
Figure 3:
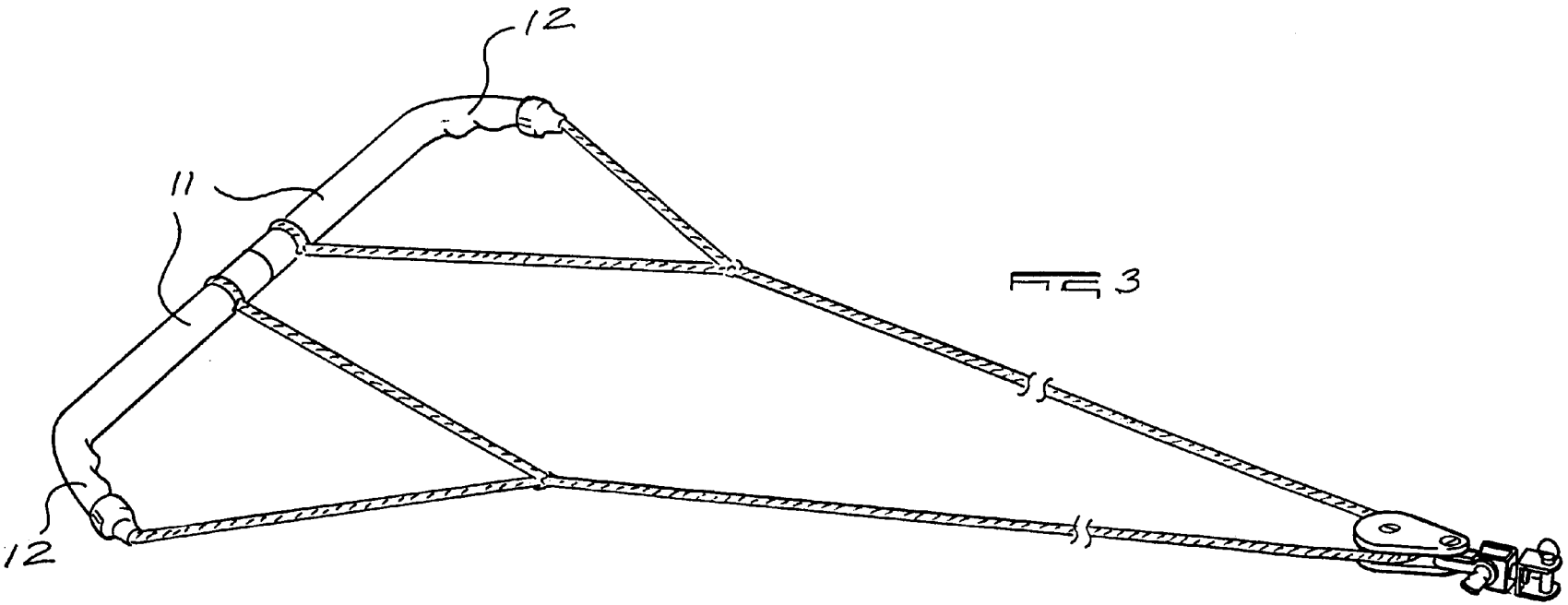
FIG. 3 is a view similar to FIG. 2 but of a second embodiment of the invention illustrating the handles attached to each other in collinear relationship.
Figure 4:
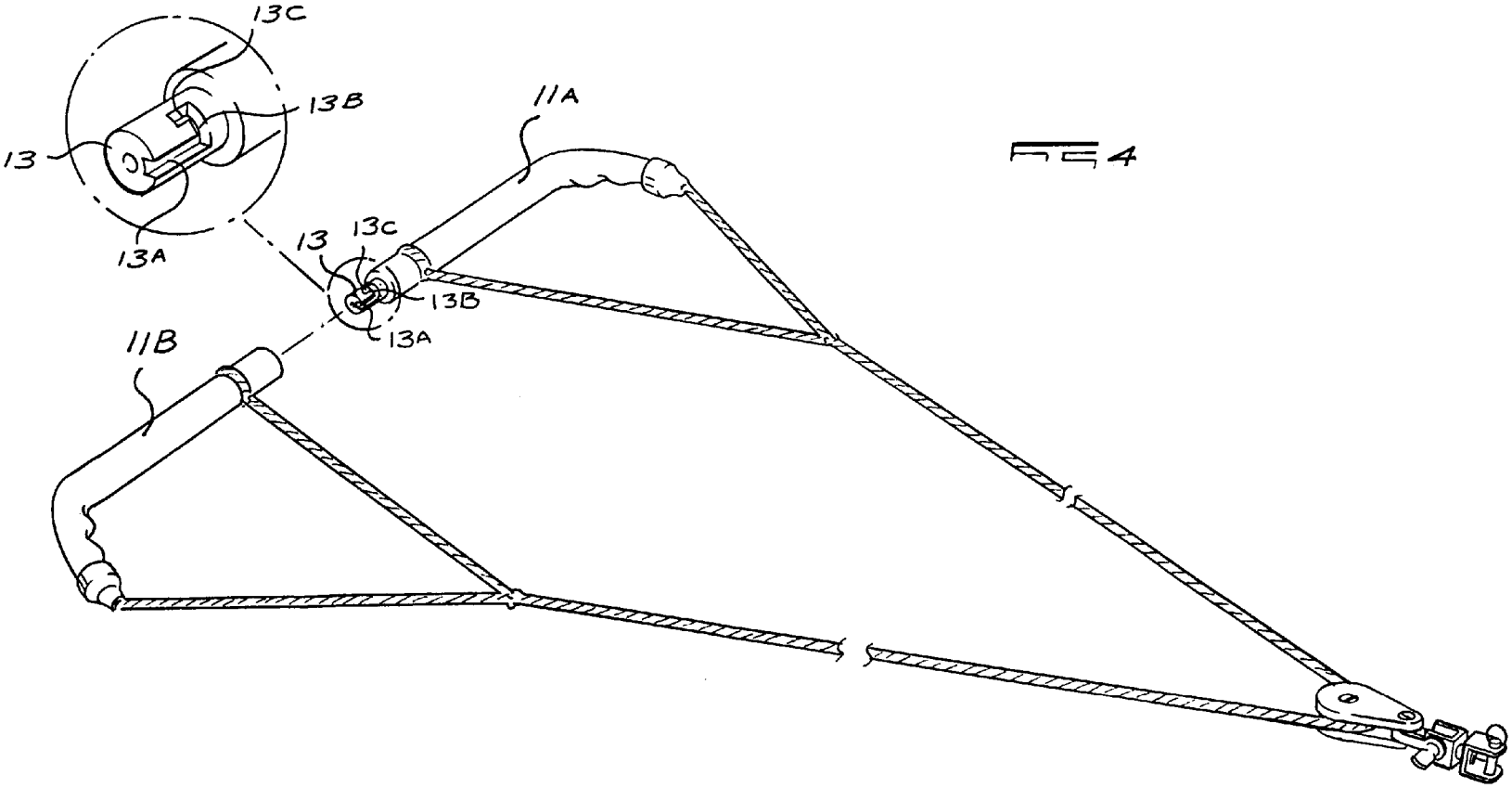
FIG. 4 is a view similar to FIG. 3 but with the individual handles disengaged from each other; and, FIG. 5 is a longitudinal section taken through the coupling whereby the two handles of FIGS. 3 and 4 are interconnected.
Figure 5:
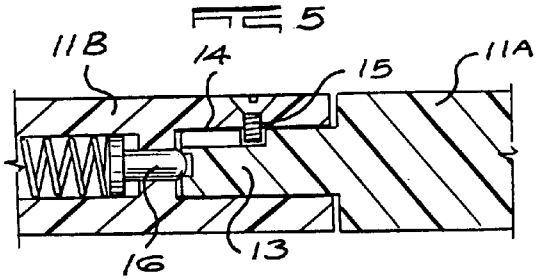

Turning now to the embodiment of the invention illustrated in FIGS. 3 to 5, the arrangement is substantially the same as is illustrated in FIG. 2 apart from the fact that the ends of the handles (11) opposite the extensions (12) can be releasably inter-connected in collinear relationship to each other as shown in FIG. 3.

In order to achieve this the one handle **(11*a*) (See FIG. 4) has a bayonet type of spigot (13) extending co-axially therefrom and this spigot extends into a socket (14) in the other handle (11*b*). For convenience, in this case, the retaining lug (15) of the bayonet configuration is formed by a screw extending into the socket from the outside thereof. The bayonet type of spigot 13 has a bayonet slot 13A, a hooked end 13B and a catch 13C which cooperate with retaining lug 15 in conventional manner. Also a spring loaded lock (16) is provided for urging the spigot (13) out of the socket (14) so that the bayonet connection is maintained in full engagement and requires a pushing and rotation of the two handles relative to each other in order to depress the spring and enable the bayonet to disengage. Specifically, the disengagement of the bayonet configuration is effected by pushing the two handles slightly towards each other and then, on rotation of the handles relative to each other, the retaining lug 15 rides out of the catch 13C against the bias of the spring to move over the hooded end 13B into the bayonet slot 13A** to allow the two handles to disengage. In a reverse action the two handles can be engaged in a click stop manner.

It will be understood that the embodiment of the invention illustrated in FIGS. 3 to 5 provides even further variation and facility for performing different manoeuvres, as may be required. It is a simple matter to engage and disengage the two handles one from the other whilst being towed and this facility is seen as an added advantage over the embodiment of the invention described with reference to FIG. 2.

It has been found that use of a tow rope assembly as described above therefore greatly enhances the pleasure and versatility of an activity such as water skiing. By the same token other sports and recreational activities carried out using a tow rope according to the prior art can be very much enhanced by using the ski rope assembly provided by this invention.

It will be understood that numerous variations may be made to the embodiment of the invention described above without departing from the scope hereof. In particular the attachment member could be of any suitable form and it may be found that a simple nylon block having a guide path for the rope interconnecting the handles will be adequate. Also, the handles may assume any particular design or shape without restrictions.

What I/we claim as new and desire to secure by Letters Patent is:

1. A ski rope assembly comprising a handle arrangement connected by means of a bridle rope to an attachment member, the attachment member being attached to a ski rope for use on a towing vehicle, wherein the handle arrangement comprises a pair of handles inter-connected by the bridle rope, each handle being configured to accommodate a single hand of a skier, with one handle being attached to each end of the bridle rope and wherein the attachment member is movable along at least a central region of the length of the bridle rope.

2. A ski rope assembly as claimed in claim 1 in which the attachment member has a pulley on which the bridle rope inter-connecting the handles is to move in use.

3. A ski rope assembly as claimed in claim 1 in which the attachment member has an eye through which the ski rope can be threaded and fastened.

4. A ski rope assembly as claimed in claim 3 in which the eye is attached to the attachment member by way of a swivel.

5. A ski rope assembly as claimed in claim 1 in which each handle has at an end thereof a lateral extension directed generally at an obtuse angle to the handle itself.

6. A ski rope assembly as claimed in claim 1 in which the two handles are releasably attachable to each other in collinear relationship.

7. A ski rope assembly as claimed in claim 6 in which the handles have a bayonet spigot and socket assembly for effecting such releasable attachment of the handles together.

8. A ski rope assembly as claimed in claim 7 in which a spring is provided to has the handles in the attached condition, one to the other.

* * * * *